US005575626A

United States Patent [19]

Brown et al.

[11] Patent Number: 5,575,626

[45] Date of Patent: Nov. 19, 1996

[54] CRYOGENIC PUMP

[75] Inventors: Bruce G. Brown, Corona, Calif.; Robert E. Crowl, Corpus Christi, Tex.; Phillip J. Westermann, El Toro, Calif.

[73] Assignee: Cryogenic Group, Inc., Murrieta, Calif.

[21] Appl. No.: 439,723

[22] Filed: May 12, 1995

[51] Int. Cl.[6] ..... F16J 10/02; F04B 25/04

[52] U.S. Cl. ..... 417/251; 417/259; 417/266; 417/901; 62/50.6

[58] Field of Search ..... 417/901, 259, 417/251, 266; 62/50.7, 50.6

[56] References Cited

U.S. PATENT DOCUMENTS

| | | | |
|---|---|---|---|
| 2,888,879 | 6/1959 | Gaarder | 417/901 X |
| 2,931,313 | 4/1960 | Hughes | 417/901 X |
| 3,016,717 | 1/1962 | Gottzmann | 417/901 X |
| 3,114,326 | 12/1963 | Yaindl | 62/50.7 X |
| 3,220,202 | 11/1965 | Gottzman | 417/901 X |
| 4,239,460 | 12/1980 | Gölz . | |
| 4,334,833 | 6/1982 | Gozzi | 417/266 X |
| 4,345,880 | 8/1982 | Zanarini | 417/266 X |
| 4,576,557 | 3/1986 | Pevzner | 417/901 X |
| 4,639,197 | 1/1987 | Tornare et al. | 417/901 X |
| 4,681,516 | 7/1987 | O'Hara et al. | 417/259 |
| 4,792,289 | 12/1988 | Nieratschker | 417/259 |
| 5,188,519 | 2/1993 | Spulgis . | |

FOREIGN PATENT DOCUMENTS

| | | | |
|---|---|---|---|
| 2731805 | 1/1978 | Germany | 417/901 |

*Primary Examiner*—Richard E. Gluck
*Attorney, Agent, or Firm*—Harold L. Jackson

[57] ABSTRACT

A cryogenic pump is disclosed for pumping liquified gas from one container to another container or a point of use. The pump comprises a series of chambers and coupling valves for progressively pumping a liquified gas from an inlet end located within and adjacent to the bottom of the container to an outlet conduit. The pump arrangement allows the container to be substantially emptied thereby avoiding waste of the contained liquified gas.

20 Claims, 2 Drawing Sheets

CRYOGENIC PUMP

FIELD OF THE INVENTION

The invention relates generally to mechanical pumps and more particularly to cryogenic pumps for pumping liquified gases in their saturated liquid state.

BACKGROUND OF THE INVENTION

Cryogenic liquids or fluids such as hydrogen, oxygen, nitrogen, argon and liquified hydrocarbons i.e., methane or natural gas, are typically stored and transported in pressurized containers. The containers are typically well-insulated and refrigerated to very low temperatures. Pumps are used to transfer such cryogenic fluids between containers or from one container to a point of use. While many pumps have evolved over the years, mechanical pumps of the reciprocating type have been preferred for many applications. Such mechanical cryogenic pumps are required to have a net positive suction head (NPSH), that is, a suction head above zero, to prevent the loss of prime of the pump or to prevent cavitation. Flow limitations generally result from the maintenance of an NPSH and it is therefore desirable to employ pumps that can operate with a negative suction head or NPSH below zero.

One example of such a mechanical cryogenic pump is illustrated in U.S. Pat. No. 5,188,519 issued to Splugis. The pump disclosed in this patent includes a cylinder having a liquid inlet and a liquid outlet, and a piston reciprocally movable within the cylinder and generally intermediate the liquid inlet and liquid outlet. The piston has a liquid flow conduit therethrough generally co-axial with the cylinder, the liquid flow conduit having an inlet end in liquid communication with the cylinder liquid inlet and an outlet end in liquid communication with the cylinder liquid outlet. A piston rod is attached to the piston for reciprocally moving the piston within the cylinder in a direction toward the cylinder liquid outlet. A valve operatively associated with and intermediate the piston rod and the piston liquid flow conduit inlet end alternately opens and closes the inlet to liquid flow, the valve being closed when the piston rod and piston are moved in the direction toward the cylinder liquid outlet and being open when the piston rod and piston are moved in the reciprocal direction.

Another example of a reciprocating cryogenic pump is disclosed in U.S. Pat. No. 4,239,460 issued to Golz which describes a pump designed to operate with a NPSH below zero. This pump employs a reciprocating piston which divides a cylindrical housing into a suction and an evacuation chamber. A gas inlet port extends through the side of the housing for channeling liquified gas into the suction chamber. A fixed piston extends from an outlet end of the housing into the evacuation chamber. The fixed position slides within a cylindrical skirt carried by the reciprocating piston to form a high pressure chamber. The pressurized liquified gas is supplied to an outlet through a passageway within the fixed piston. One way valves control the flow of liquified gas though the inlet, the several chambers and the outlet.

Applicants in co-pending application entitled Cryogenic Pumps, Ser. No. 08/384,970, filed Feb. 7, 1995 and assigned to the assignee of this application, disclose an improved mechanical pump which includes a reciprocating piston positioned in a first cylindrical housing for dividing the interior of the housing into a supercharger chamber and an evacuation chamber on opposite sides of the piston. At least one supercharger chamber inlet port extends through the cylindrical housing directly behind the reciprocating piston for channeling liquified gas from a liquified gas inlet into the supercharger chamber. A fixed piston is mounted in the housing and extends into the evacuation chamber. The fixed piston engages a skirt carried by the moveable piston to form a high pressure chamber between the movable and fixed pistons. A liquified gas outlet extends through the fixed piston from the high pressure chamber to the ultimate outlet. Excess fluid from the supercharger chamber is vented back into the storage reservoir preferably through one or more restricted orifices, eliminating the need for a pressure relieve valve.

These reciprocating mechanical pumps have a similar drawback in that they are not adapted for submission within a cryogenic liquid container and in any event would not be able to empty the contents of such a container because of the arrangement of the several components including the liquified gas inlet. An amount of cryogenic fluid remains in the container. It would be an advancement in the art to have an improved cryogenic pump which can be submerged within a cryogenic container and capable of emptying all or most of the fluid from such a container.

SUMMARY OF THE INVENTION

An improved cryogenic pump capable of being submerged within a pressurized cryogenic container for transferring liquified gases therefrom to another container or a point of use, in accordance with the present invention, includes a reciprocating piston positioned in a inner cylindrical housing. The piston divides the interior of this inner housing into a supercharger chamber and a sump chamber on opposite sides of the piston. At one end of the pump a liquified gas inlet extends between the liquified gas container and the sump chamber for channeling liquified gas from the pressurized container into the pump. An outer housing surrounds the inner housing forming a liquified gas reservoir or precharge chamber therebetween. A supercharger inlet port extends through the cylindrical inner housing directly behind the reciprocating piston for channeling liquified gas from the precharge chamber gas inlet into the supercharger chamber. A fixed piston is mounted in the housing and extends into the sump chamber. The fixed piston engages a skirt carried by the moveable piston to a high pressure chamber between the movable and fixed pistons. A liquified gas outlet extends through the fixed piston from the high pressure chamber.

With this pump arrangement, the cryogenic pump can be placed in the liquified gas container with the liquified gas inlet located adjacent the bottom of the container. All or most of the liquified gas can therefore be removed from the container in a removable or transfer operation.

The structure and operation of the present invention can best be understood by reference to the following description taken in conjunction with the accompanying drawings wherein like components in the several figures are designated with the same reference numerals.

DESCRIPTION OF THE PREFERRED EMBODIMENT

Figure 1:
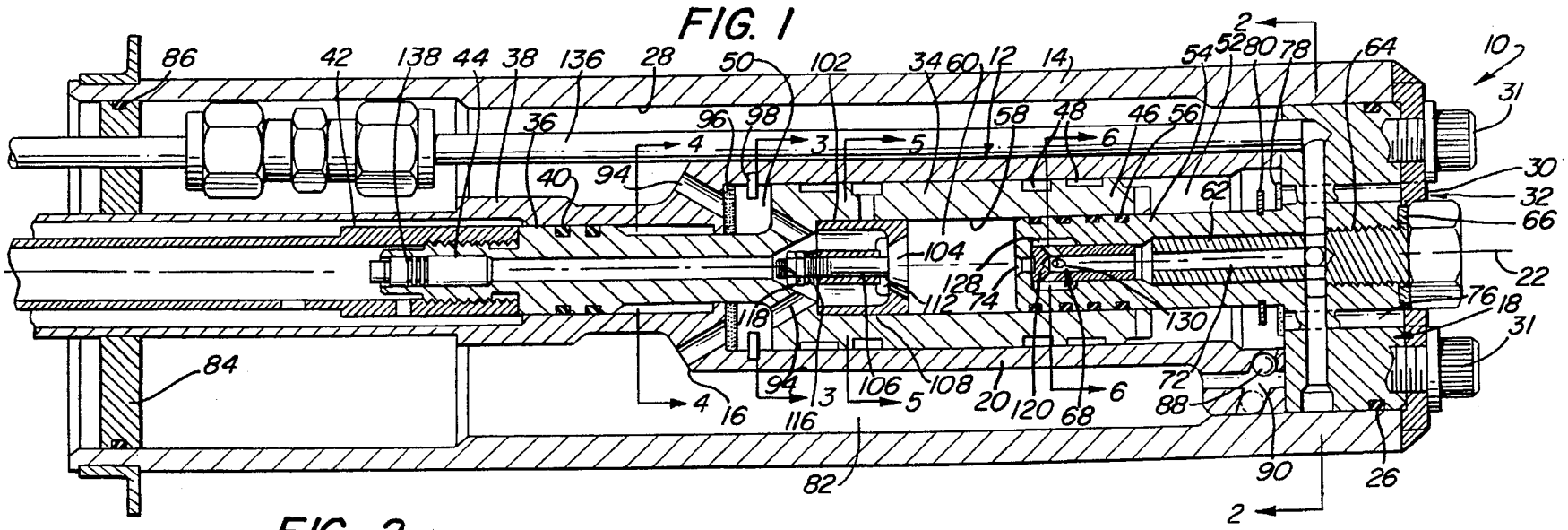
FIG. 1 is a cross-sectional view of a cryogenic pump in accordance with the present invention.

Referring now to the drawings and in particular to FIG. 1, a liquified gas pump 10, in accordance with the present invention, includes an inner cylindrical housing 12 and an outer cylindrical housing 14 disposed around the inner cylindrical housing. The inner cylindrical housing has an inner housing inlet end section 16, a pump inlet/discharge end section 18, a central section 20, and a longitudinal axis 22. The inner housing inlet end section 16 is formed integrally with the central section 20 while the pump inlet/discharge end section comprises a combined pump inlet/discharge head 24 which is shown as a disc-shaped block portion positioned at the end of the inner cylindrical housing 12 and within the end of the outer cylindrical housing 14. An O-ring 26 seats in a circumferential groove in the disc-shaped block portion providing a seal along the inner wall 28 of the outer cylindrical housing 14 (described in more detail hereinbelow). An end plate 30 is bolted to this disc-shaped block portion by a plurality of bolts 31, thereby capping off the end 32 of the outer cylindrical housing and the bottom end of the pump 10 that will sit adjacent to the bottom of a liquid gas container (shown with more particularity in FIG. 7).

A reciprocating piston 34 mounted within the inner cylindrical housing 12 reciprocally moves in this housing along the longitudinal axis 22. A drive rod 36 extends rearwardly from the reciprocating piston 34 and the two may be formed together as an integra unit as shown in FIG. 1. The drive rod 36 extends through a rearwardly extending portion 38 of the inner cylindrical housing 12. Shaft seal 40 located between the drive rod 36 and the inner cylindrical wall of the rearwardly extending portion 38, inhibit the egress of fluid along the drive rod 36. The drive rod 36 may be coupled to a suitable driving mechanism such as an electric motor and cam arrangement (not shown) by means of a hollow cam follower rod 42, for example. The cam follower rod 42 moves the drive rod 36 and reciprocating piston 34 back and forth providing the pumping action for this mechanical pump arrangement. The drive rod 36 and the cam follower rod 42 may be coupled by cooperative thread sections 44.

The reciprocating piston 34 carries a forwardly extending cylindrical skirt 46, the skirt having circumferential ring riders and piston rings 48 which engage the inner wall of the central section 20 of the inner cylindrical housing 12. The reciprocating piston 34 divides the interior of the inner housing 12 into a supercharger chamber 50 at the inlet end section 16 of the inner cylindrical housing and a sump chamber 52 at the pump inlet/discharge end section 18 which sump chamber is a low pressure chamber.

A fixed piston 54 extends from the pump inlet/discharge head 24 into the reciprocating piston skirt 46. The fixed piston 54 includes piston rings 56 which engage the inner cylindrically shaped wall 58 of skirt 46. A high pressure chamber 60 is formed between the reciprocating and fixed pistons 34 and 54. A plug 62 bolted to the pump inlet/discharge head 24 extends through the inlet/discharge head and into the fixed piston 54. The plug 62 is affixed to the inlet/discharge head 24 by cooperative threads 64 on the plug 62 and in the inlet/discharge head 24 and gasket 66 seals the plug 62 with the inlet/discharge head. Outlet or discharge bores 68, 72, and 70 extend through the end of the fixed piston 54, the plug 62 and the inlet/discharge head 24. More specifically, as shown with more particularly in FIGS. 1 and 2, the inlet/discharge head 24 and intersects the central bore 72 through plug 62, which central bore 72 is aligned with a fixed piston end hole 74 in the end of the fixed piston 54.

The fluid from the container enters the pump 10 through a plurality of inlet suction ports 76 which extend through the end plate 30 and pump inlet/discharge head 24 into the sump chamber 52. A sump chamber valve 78 in the form of a planar disk, is moveable along the longitudinal axis from the closed position shown in FIG. 1 to an open position when the planar disk engages retainer ring 80 which is secured in an annular groove on the fixed piston 54. The sump chamber 52 provides the first chamber that fluid enters within the pump 10 from the storage container. Fluid is drawn into the sump chamber when a low pressure condition exists in the sump chamber.

A precharge chamber 82 or precharge fluid reservoir is formed between inner cylindrical housing 12 and outer cylindrical housing 14. The two cylindrical housings are concentrically mounted and capped off, at one end by end cap 84 and at the other end by discharge head 24. Annular O-rings 86 seal the respective ends of the pump. Precharge chamber 82 is in fluid communication with the sump chamber 52 when a ball valve 88 moves and opens a bore 90 therebetween. Precharge chamber 82 provides the second chambered area of the pump 10.

Figure 4:
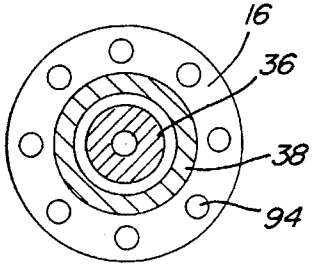
FIG. 4 is a cross-sectional view of the pump of FIG. 1 taken along lines 4—4.

A third fluid chamber is provided by supercharger chamber 50. The inner housing inlet end section 16 of the inner housing 12 includes a plurality of ports or passageways 94 (shown in FIG. 1 and 4) which channel liquified gas from the precharge chamber 82 into the supercharger chamber 50. The supercharger chamber 50 sits directly behind reciprocating piston 34. A supercharger valve 96, which is in the form of another planar disk, moves along the longitudinal axis from a closed position shown in FIG. 1 to an open position when the planar disk engages a retainer ring 98 secured to the inner housing.

Figure 3:
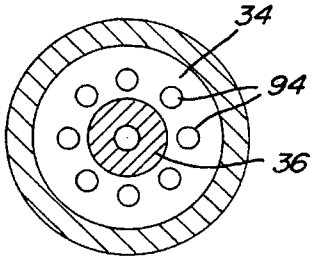
FIG. 3 is a cross-sectional view of the pump of FIG. 1 taken along lines 3—3.
Figure 5:
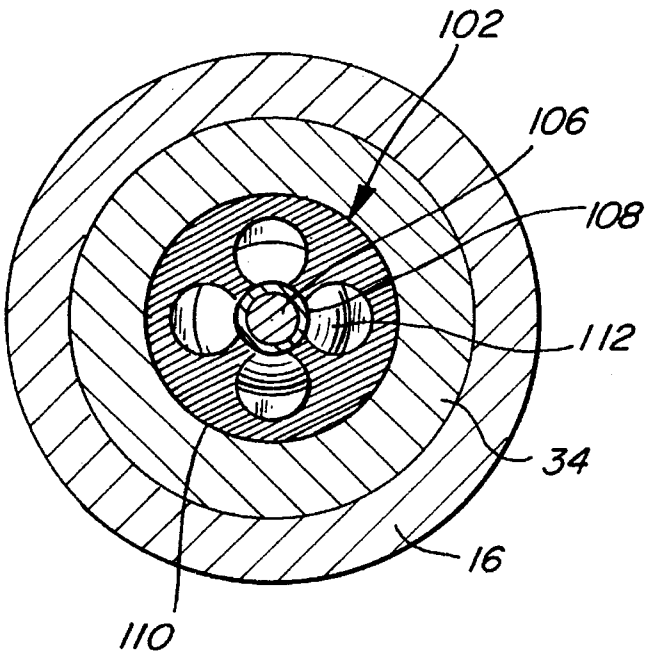
FIG. 5 is an enlarged partial cross-sectional view of the pump of FIG. 1 taken along lines 5—5.

A high pressure chamber 60, forming a fourth chamber, lies forward of the supercharger chamber 50 and receives fluid from the supercharger chamber at the appropriate times through suction valve 102, as shown with more particularity in FIGS. 1 and 5. Suction valve 102 comprises a tapered-shaped-disc head 104 and a stem 106, the stem being slideably mounted in a bushing 108. The bushing 108 which may be made of a moly-teflon material with a steel backing (commonly referred to as a DU bushing) is press fit within the rearward portion of skirt 46 of reciprocating piston 34. The valve body 110 of the suction valve 102 includes ports 112 (see FIG. 5) which in conjunction with passageways 94 in the rear portion of the reciprocating piston 34 (see FIGS. 1 and 3) allows liquified gas from the supercharger chamber 50 to enter the high pressure chamber 60 when the suction valve 102 is open (i.e., moved to the right from the position shown in FIG. 1). The suction valve 102 is biased toward the closed position by a spring (not shown) located on stem 106 between the bushing and lock nuts 118, as illustrated in FIG. 1. The compressive force of the spring 116 may be adjusted by lock nuts 118 mounted on the threaded rear portion of the stem 106 (only until the proper travel of the valve is obtained).

Figure 2:
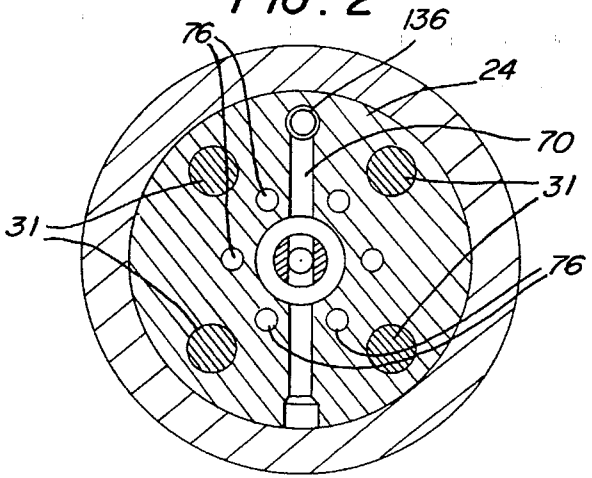
FIG. 2 is a cross-sectional view of the pump of FIG. 1 taken along lines 2—2.
Figure 6:
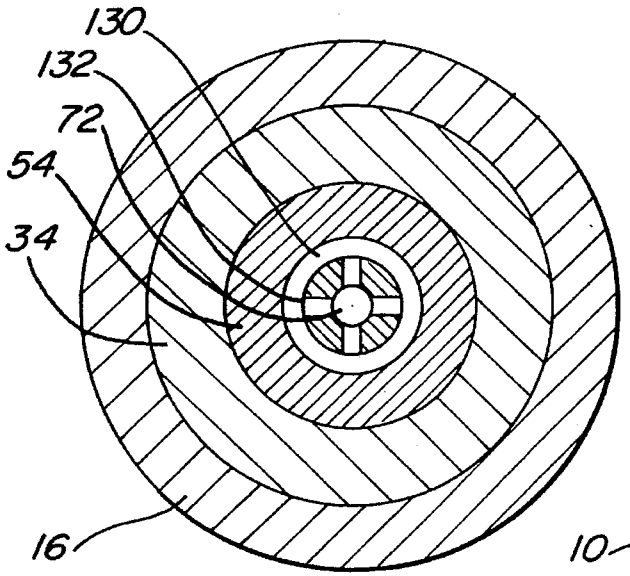
FIG. 6 is an enlarged partial cross-sectional view of the pump of FIG. 1 taken along lines 6—6.

The fluid within the high pressure chamber exits the pump at the appropriate time in the pump cycle via the outlet bores 68, 70, 72 which were described above. A discharge valve 120, located between the upstream end of the plug bore 72 and the fixed piston end hole 126, engages a discharge valve seat 128 on the interior of the fixed piston 54, the valve seat providing an opening or closing of the fixed piston end hole 74. When the discharge valve 120 is forced forwardly (toward the discharge end) fluid may flow through fixed piston end hole 74, around the valve 120 through peripheral space 130 between the fixed piston 54 and valve 120 and into discharge duct or cross bores 132 and longitudinal bore 72 in the valve, as shown with more particularity in FIG. 6. An outlet or discharge line 136 is connected to the inlet/discharge head 24 for receiving the high pressure discharged liquified gas as shown in FIGS. 1 and 2.

In case the pressure in the supercharger chamber 50 becomes too high, the reciprocating piston 34 contains a poppet valve 138 which provides pressure relief through central bore in the drive rod 36 of the reciprocating piston to an aligned bore in the cam follower rod 42. Excess fluid or gas that is vented through the drive rod 36 reenters the container and is recycled. Venting occurs during the rearward stroke of the reciprocating piston 34 as will be explained in more detail.

In operation the following actions occur during the rearward travel or stroke of the reciprocating piston 34 (i.e. away from the inlet/discharge head):

(1) The pressure in the sump chamber 52 decreases allowing higher pressure liquified gas in the storage container to act on the disk valve 78 and to be drawn into the sump chamber 52.

(2) The liquified gas and any vapor is compressed in the supercharger chamber 50 due to the decreasing volume therein. The increasing pressure liquifies any vaporized gas in the supercharger chamber and this higher pressure liquid forces the valve 102 toward the inlet/discharge head 24 against the action of the spring 116 thereby allowing liquified gas to enter the high pressure chamber 60.

(3) The high pressure buildup in the supercharger chamber 50 also closes the supercharger disk valve 96 by moving it in a longitudinal direction towards the inlet end section 16 of inner housing 12 (to the left in FIG. 1).

During the return or forward stroke of the reciprocating piston 34, i.e., toward the discharge end the following action occurs:

(1) The volume in the sump chamber 52 decreases during the forward movement of the reciprocating piston 34 and pushes ball valve 88 toward the inner wall of the outer chamber (see the position of the ball shown in dotted lines in FIG. 1). This action opens the bore 90 and allows a mixture of liquified gas and vapor within the sump chamber to enter the precharge chamber 82.

(2) The volume in the supercharger chamber 50 increases as a result of the forward movement of the reciprocating piston 34 creating a low pressure therein which moves the supercharger valve 96 forward against the retainer ring 98 and opens this valve. Liquified gas then flows into the supercharger chamber 50 until the reciprocating piston 34 reaches the end of its forward travel.

(3) Liquified gas in the high pressure chamber 60 forces the discharge valve 120 away from its seat 128 and toward the inlet/discharge head 24 thereby opening this valve. The liquified gas under pressure flows through the end hole 74 in fixed piston, the central bore 72 in plug 62 and the discharge duct 70 in inlet/discharge head 24 to outlet discharge line 136. Pressure in the high pressure chamber maintains the suction valve 102 closed during this forward stroke of the reciprocating piston 34.

Figure 7:
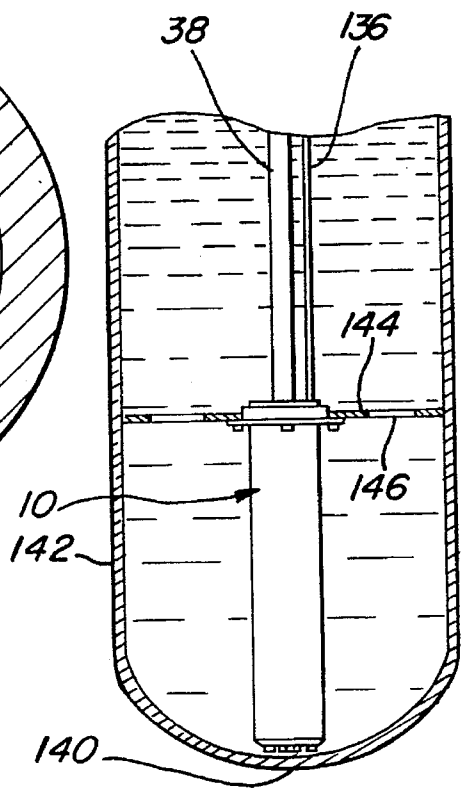
FIG. 7 is a partial cross-sectional view of a liquified gas container with the pump of FIG. 1 submerged therein.

As shown in FIG. 7, the inlet/discharge end of the pump 10 is placed adjacent the bottom 140 of a container 142 of liquified gas. Since the inlet port of the pump is at the bottom 140 of the container, substantially all of the liquified gas in the container can be more readily removed. A bracket 144, with suitable openings 146 therein, secures the pump within the container. The pump design of the present invention is particularly useful in applications where the cryogenic container or tank is mounted in a vehicle because the pumping action is not affected by liquid sloshing in the tank.

The above-described detailed description of a preferred embodiment describes the best mode contemplated by the inventors for carrying out the present invention at the time this application is filed and is offered by way of example and not by way of limitation. Accordingly, various modification may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. A submersible cryogenic pump for transferring liquified gas from a container comprising:

an inner housing having a longitudinal axis, an inner wall, an inlet end and a discharge end;

an outer housing surrounding the inner housing;

a reciprocating piston slideably positioned within the inner housing along the longitudinal axis for dividing the inner housing into a supercharger chamber and a sump chamber, the moveable piston having a skirt in sliding engagement with the inner wall of the housing, the volume of the supercharger and sump chambers changing inversely as the reciprocating piston is moved toward and away from the discharge end;

a fixed piston extending within the sump chamber in sliding engagement with the reciprocating piston skirt to form a high pressure chamber between the reciprocating and fixed pistons;

a liquified gas inlet;

a precharge chamber within the outer housing in fluid communication with the inlet end of the inner housing;

a one-way sump chamber valve connecting the liquified gas inlet at the pump discharge end to the sump chamber to allow liquified gas to enter the sump chamber when the reciprocating piston is moved away for the discharge end;

a one-way precharge chamber valve connecting the sump chamber to the precharge chamber to allow liquid to enter the precharge chamber when the reciprocating piston is moved toward the discharge end;

a one-way supercharger chamber valve connecting the precharge chamber to the supercharger chamber to allow liquified gas to enter the supercharger chamber when the reciprocating piston is moved toward the discharge end;

a one-way high pressure chamber valve connecting the supercharger chamber to the high pressure chamber when the moveable piston is moved away from the discharge end;

an outlet for the pressurized liquified gas, and a one-way discharge valve connecting the high pressure chamber to the outlet when the reciprocating piston is moved toward the discharge end.

2. The cryogenic pump defined in claim 1 wherein said liquified gas inlet comprises a plurality of ports opening into the sump chamber around a line that parallels the longitudinal axis.

3. The cryogenic pump defined in claim 1 wherein the discharge end comprises discharge head capping the discharge end of the inner housing.

4. The cryogenic pump defined in claim 3 wherein the discharge head comprises a block-shaped member, the plurality of ports extending through the block-shaped member.

5. The cryogenic pump defined in claim 4 wherein said block-shaped member has an outlet duct connecting the high pressure chamber to the outlet.

6. The cryogenic pump defined in claim 5 further comprising an outlet conduit connected to the outlet duct.

7. The cryogenic pump defined in claim 6 wherein the outlet duct opens into the outlet conduit in a plane that intersects the longitudinal axis of the pump.

8. The cryogenic pump defined in claim 1 further comprising a high pressure relief valve for venting excess liquified gas from the supercharger chamber.

9. A submersible cryogenic pump for transferring liquified gas from a container comprising:

an outer cylindrical housing having a longitudinal axis, an inlet/discharge end;

a rear end cap closing the rearward end of the outer cylindrical housing:

an inlet/discharge head closing off the other forward end of the outer cylindrical housing at the inlet/discharge end;

an inner cylindrical housing arranged within the outer cylindrical housing forming a precharge chamber in the space therebetween;

a reciprocating piston slideably positioned within the inner cylindrical housing along the longitudinal axis for dividing the inner cylindrical housing into a supercharger chamber and a sump chamber, the reciprocating piston having a skirt in sliding engagement with the inner wall of the inner housing, the volume of the supercharger and sump chambers changing inversely as the reciprocating piston is moved toward and away from the inlet/discharge end;

a fixed piston extending within the sump chamber in sliding engagement with the reciprocating piston skirt to form a high pressure chamber between the reciprocating and fixed pistons;

a supercharger chamber valve connected between the supercharger chamber and the precharge chamber for admitting liquified gas into the supercharger chamber;

a liquified gas inlet at the inlet/discharge end;

a one-way sump chamber valve connecting the liquified gas inlet to the sump chamber to allow liquified gas to enter the sump chamber through the liquified/gas inlet;

a one-way precharge chamber valve connecting the sump chamber to the precharge chamber to allow liquified gas to enter the precharge chamber;

a high pressure chamber valve connected between the supercharger chamber and the high pressure chamber for controlling the flow of liquid gas into the high pressure chamber;

a high pressure outlet extending through the fixed piston, and a discharge valve arranged in the high pressure outlet for controlling liquified gas exiting through the high pressure gas outlet.

10. The pump defined in claim 9 wherein the inlet/discharge head is a disc-shaped block portion disposed in the other forward end of the outer cylindrical housing.

11. The pump defined in claim 10 wherein the fixed piston is integrally formed with the inlet/discharge head.

12. The pump defined in claim 10 wherein the liquified gas inlet comprises at least one port integrally formed in the disc-shaped block portion.

13. The pump defined in claim 12 wherein the at least one port comprises a plurality of ports opening into the sump chamber around a line essentially parallel to the longitudinal axis.

14. The pump defined in claim 10 further comprising an outlet conduit extending into the pump within the precharge chamber.

15. The pump defined in claim 14 wherein the outlet conduit intersects the outlet in the disc-shaped block member.

16. A submersible cryogenic bump for transferring liquified gases from a container comprising:

a pump housing having a longitudinal axis and a discharge end;

a reciprocating piston positioned within the housing along the longitudinal axis for dividing the interior of the housing into a supercharger chamber and a sump chamber, the volume of the supercharger and sump chambers changing inversely as the piston is moved toward and away from the discharge end of the housing;

a fixed piston extending within the sump chamber to form a variable volume high pressure chamber between the reciprocating and fixed pistons;

a liquified gas inlet extending through the housing and into the sump chamber adjacent the discharge end;

a one-way sump chamber valve for allowing liquified gas to enter the sump chamber when the reciprocating piston travels away from the discharge end;

a precharge chamber;

a one-way precharge chamber valve connecting the sump and precharge chambers for allowing liquified gas to flow from the sump chamber into the precharge chamber;

a one-way supercharger chamber valve connected between the precharge chamber and supercharger chamber for allowing liquified gas to flow from the precharge chamber into the supercharger chamber;

a one-way high pressure chamber valve connected between high pressure chamber and the supercharger chamber for allowing gas to flow from the supercharger chamber into the high pressure chamber;

a high pressure outlet passageway in fluid communication with the high pressure chamber; and a one-way discharge valve in the outlet passageway.

17. The cryogenic pump defined in claim 16 wherein said liquified gas inlet comprises a plurality of ports opening into the sump chamber around a line that parallels the longitudinal axis.

18. The cryogenic pump defined in claim 16 further comprising a high pressure relief valve for venting excess liquified gas from the supercharger chamber.

19. The cryogenic pump of claim 16 wherein the reciprocating piston is formed with an elongated bore concentric with the longitudinal axis, and wherein the fixed piston extends within the longitudinal bore in the reciprocating piston.

20. The cryogenic pump of claim 19 wherein the outlet passageway extends through the fixed piston.

* * * * *

UNITED STATES PATENT AND TRADEMARK OFFICE

CERTIFICATE OF CORRECTION

PATENT NO. : 5,575,626

DATED : November 19, 1996

INVENTOR(S) : Brown et al

It is certified that error appears in the above-identified patent and that said Letters Patent is hereby corrected as shown below:

Column 8, line 19, "bump" should read --pump--.

Signed and Sealed this

Fourth Day of March, 1997

Bruce Lehman

*Attest:*

BRUCE LEHMAN

*Attesting Officer*

*Commissioner of Patents and Trademarks*